US005542462A

United States Patent [19]

Elsenheimer et al.

[11] Patent Number: 5,542,462

[45] Date of Patent: Aug. 6, 1996

[54] CORD RELEASE DEVICE

[75] Inventors: John A. Elsenheimer, Freeport; David K. Bried, Loves Park; Jeffrey L. Sands; Donald Wildes, both of Freeport, all of Ill.; J. Patrick Nugent, Greensboro, N.C.

[73] Assignee: Newell Operating Company, Freeport, Ill.

[21] Appl. No.: 315,972

[22] Filed: Sep. 30, 1994

[51] Int. Cl.[6] ..... E06B 9/38

[52] U.S. Cl. ..... 160/178; 160/173; 16/122; 24/128; 24/115 F

[58] Field of Search ..... 160/178.1 R, 178.1 V, 160/173 R; 24/128, 115 F, 129 D, 129 R, 130, 116 A, 116 H, 578, 662, 602; 16/114 B, 122, 127, 216, 217, 218

[56] References Cited

U.S. PATENT DOCUMENTS

| | | | |
|---|---|---|---|
| 1,368,665 | 2/1921 | Strauss | 16/122 |
| 2,292,140 | 8/1942 | Lafgren | 24/129 D |
| 2,592,696 | 4/1952 | Hoody . | |
| 3,050,803 | 8/1962 | Hulterstrum | 24/115 H |
| 4,477,947 | 10/1984 | Lyons . | |
| 4,909,298 | 3/1990 | Langhart et al. . | |

FOREIGN PATENT DOCUMENTS

| | | | |
|---|---|---|---|
| 105649 | 2/1965 | Norway | 160/178.1 |
| 1006420 | 9/1965 | United Kingdom | 160/178.1 |

*Primary Examiner*—Blair Johnson
*Attorney, Agent, or Firm*—Foley & Lardner

[57] ABSTRACT

A device for releasably coupling adjacent ends of cords includes a one piece body having a hole for mechanically securing the device to one of the cords. The body also includes another opening constructed to receive the free ends of the remaining cords and to release them if any force is exerted between the cords and toward the device.

17 Claims, 3 Drawing Sheets

FIG. 11
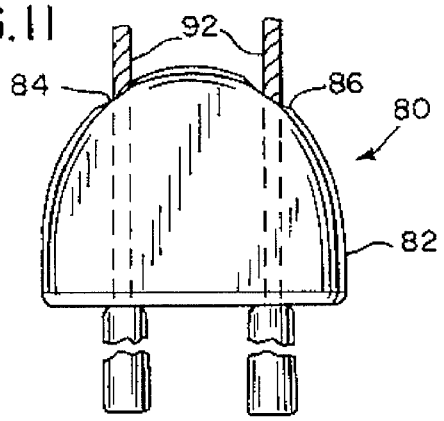
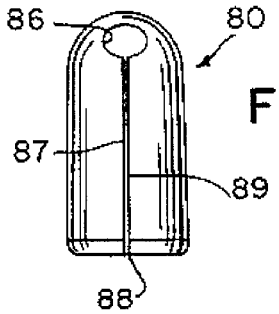
FIG. 12
FIG. 13
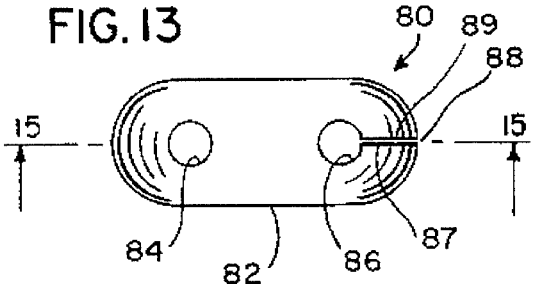
FIG. 14
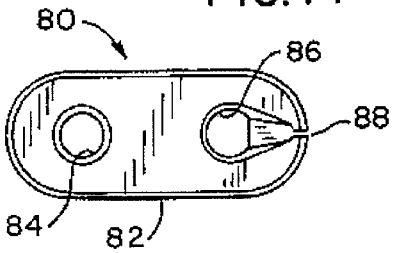
FIG. 15
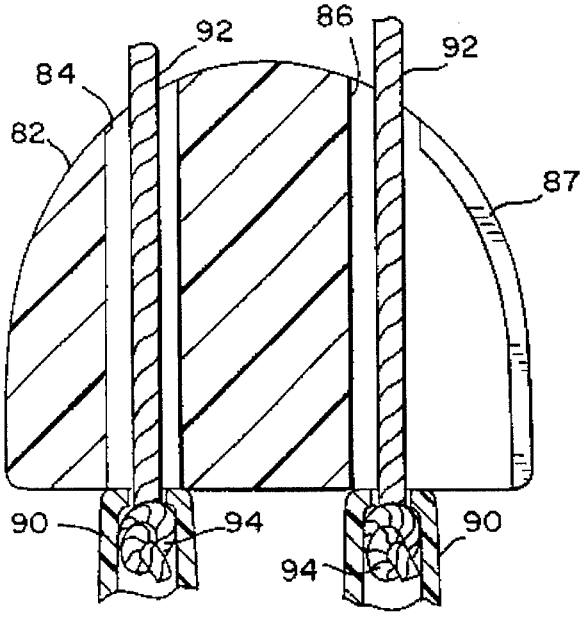
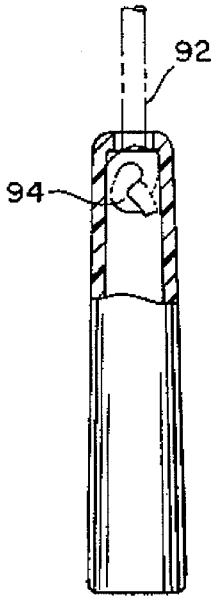
FIG. 16

CORD RELEASE DEVICE

BACKGROUND OF THE INVENTION

1. Field of the Invention

The present invention relates generally to the art of cord release devices and more specifically to devices which allow adjacent cords to separate from one another when minimal forces are present. Still more specifically, the present invention relates to devices for coupling adjacent cords, for example the cords used to manipulate window coverings, which devices allow the cords to separate freely when a force is exerted between the cords and toward the device.

2. Description of the Prior Art

Several types of cord releases are known for coupling the free ends of cords and allowing the ends of the cords to be separated if a force or pressure is exerted between the cords and toward the device. One such cord release is described in U.S. Pat. No. 4,909,298 issued Mar. 20, 1990, to R. Langhart, et al. for "Window Covering Cord Pull Safety Device."

In the Langhart, et al. patent, a scenario is described where a child can be injured by the pull cords of window coverings, such as mini-blinds, because conventionally such pull cords have been in a single piece with a loop formed intermediate the ends of the cord. The free ends of the cord are attached to operating components within the headrail of the blind. A child, or a pet, could become injured if it became ensnared in the loop.

The solution suggested in the Langhart, et al. patent is to sever the loop and to couple a member to each newly created cord end, which members are then coupled with one another through a variety of detachable coupling techniques. Several of the suggested coupling techniques include Velcro®, magnets, snaps and the like. Using these members, injury is said to be prevented because the two members will separate if pressure is exerted downwardly toward the members. In preferred embodiments described in this patent, the members are specially configured with rounded edges and the like and are also configured for being grasped by the user for manipulating the window covering in conventional ways.

Another cord release device is known for use in coupling the free end of the drawstring of clothing, such as hooded outerwear. This device quickly releases the cord ends in the event the wearer exerts forces in a direction between the cords and toward the device. See U.S. Pat. No. 4,477,947, issued Oct. 23, 1984, to W. Lyons for "Drawstring Fastener".

A need still exists for other types of cord release devices which can be used in these two fields, as well as others where it may be desirable in a first instance to have the ends of adjacent cords be attached and where in a second instance it is desirable to have the ends of the cords quickly separate if a force is exerted toward the device and between the cords. It may, for example, be desirable from a manufacturing, aesthetic or end use perspective to achieve these capabilities while using only a single piece. Or it may be desirable to join the cords to one another, rather than join the members together which are in turn secured to individual cords.

Other needs exist for devices which perform the release and coupling functions previously described, but which do so for a larger number of cords than the two shown in the Langhart, et al. patent. It is now very common to find window coverings, for example mini-blinds, which include three or more pull cords.

So while the systems described in the aforementioned United States patents provide certain safety advantages over the loop system employed in many earlier window coverings and other products, they do not solve all manufacturing and application needs. Accordingly, cord release devices which are easy to manufacture and/or which can be used with multiple cords would also be highly desirable. New cord release systems are therefore highly desirable and would represent significant advances in this art.

SUMMARY OF THE INVENTION

The present invention features a cord release system which accomplishes several of the unsatisfied needs mentioned in the background section of this specification. More specifically, the present invention features a cord release device which is of a one piece construction and which may be used with two or more cords.

The present invention also features a cord release device in which only one of the cords is attached to the device and in which the other cord ends are detachably received by the device in such a manner that they will be released when a force is exerted between the cords and in a direction toward the device.

The present invention further features a cord release device which securely holds the cord ends together when the device is grasped by the hand of a user who desires to manipulate the window covering or other article with which the cord release device is used.

Still further, the present invention relates to a cord release device which is inexpensive to manufacture, which is easy to install on new products which may be added to existing products as a replacement for cord loops and which may be prepared in a variety of colors, sizes and shapes to complement the aesthetics of the article with which it is to be used.

How these features of the present invention, and others which will become apparent to those skilled in the art who have read this disclosure, are accomplished will be described in the following detailed description of the preferred embodiment taken in conjunction with the drawings. Generally, however, the features are accomplished in a one piece cord release device, most preferably formed from a pliable material. While many shapes may be employed, for purposes of this summary, it may be assumed that the device is shaped like a hollow, truncated cone having a generally flat top and a depending and flaring skirt. The top includes a first hole through which one of the cords is passed and knotted. In this manner, the cord release device is held at the free end of one of the cords and will not fall if the cord release feature is ever utilized. A second open area is provided in the top of the device which extends toward the perimeter of the top and then through skirt. The second open area is adapted to receive the other cord ends, preferably knotted. This opening is shaped so that the ends of such other cords will quickly release from the device if a lateral force is applied between the cords and in the direction of the device. The pliability of the device, together with the shape of the second opening, are such that the opening will constrict around the other cords when the device is grasped by a user. As soon as the user is finished with whatever manipulation of the window covering or other article is needed, the device returns to its original shape. How other features of the invention are accomplished will become apparent to those skilled in the art after reading the specification, and such other ways are deemed to fall within the scope of the present invention if they fall within the scope of the claims which are appended hereto.

BRIEF DESCRIPTION OF THE DRAWINGS

In the drawings, like reference numerals are used to designate like components, and:

FIG. 11 is a side view of a crescent shaped form of release device;

FIG. 12 is a front elevation view of FIG. 11;

FIG. 13 is a top view of FIG. 11;

FIG. 14 is a bottom view of FIG. 11;

FIG. 15 is a view taken on line 15—15 of FIG. 13; and

FIG. 16 is a view of a tassel mounted on the end of one of the cords.

DETAILED DESCRIPTION OF THE PREFERRED EMBODIMENT

Before beginning the description of the most preferred and illustrated embodiment of the present invention, several comments should be made about the scope and applicability thereof.

First, no special drawings are used to describe the window covering with which the preferred embodiment may be employed. This is because the cord release device of the present invention has wide applicability for such items as shades, mini-blinds, and pleated shades. For example, in the mini-blind field, pull cords are commonly used to raise and lower a bottom rail, which in turn causes horizontal slats held in a ladder arrangement to be stacked or unstacked. This causes an opening or closing of the blinds.

Second, the particular size and configuration of the illustrated cord release device is not critical, and such configuration can vary widely without departing from the intended scope of the present invention. For example, the device can be more cylindrical, the width to length ratios can differ, and the device can be made from several different types of material and a wide variety of colors. Furthermore, the external surface could contain a design as is known in the art of pull tassels for window coverings.

With regard to materials of construction, the cord release device of the present invention is preferably made from an elastomeric material, such as a natural or synthetic rubber, resin or the like. The preferred material is a high density polyethylene elastomer. Other elastomers may also be used. The particular durometer of the elastomer can vary depending on factors which will become more apparent as the description continues.

Finally, the illustrations show three cords, one of which is secured to the device and the other two of which are releasably retained thereby. Two cords could be employed, as could more than three, e.g. 4–8 or more. The only modification which may be desirable to accommodate a particular number of cords will be to size the aforementioned second open area (to be described and illustrated in depth hereafter) to facilitate easy insertion of the cord ends and to ensure the easy release thereof under release conditions, i.e. a force being exerted between the cords and in the direction of the device. It is undesirable to have so many cords, for a particular sized opening, that the ends of the cords would be "crammed" into the device, increasing the likelihood that they could be caught up or bound with one another, thereby disabling the intended cord release function.

Figure 1:
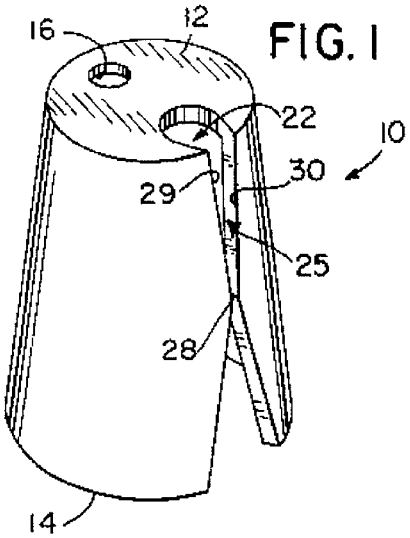
FIG. 1 is a perspective view of a cord release device according to the most preferred form of the present invention.
Figure 2:
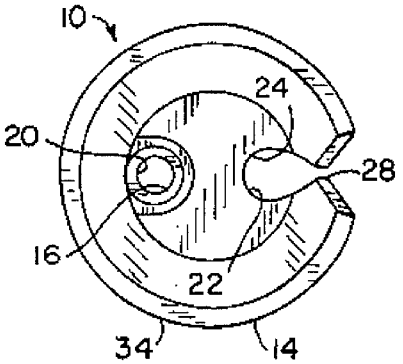
FIG. 2 is a bottom view of the device shown in FIG. 1.

Proceeding now to a description of FIGS. 1 and 2, a cord release device 10 according to the most preferred embodiment of the present invention is shown in perspective view. It has a generally circular top 12 and a depending flared skirt 14 and is molded from the aforementioned high density polyethylene elastomer or other such material and hence is elastomeric in nature.

Device 10 includes a hole 16 in its top 12, preferably not at its center but rather nearer the periphery thereof. The hole 16 is large enough to allow a first cord 35 (shown in FIGS. 3 and 4) to be threaded therethrough, knotted at its free end 36 and thereby to be retained. In the illustrated embodiment, a small, cylindrical wall 20 is formed on the inner surface of top 12 to receive the knot from this cord. In this manner, the knot is out of the way when other cords are subsequently added and opportunities for cords to become entangled, one with another, are thereby minimized. In the preferred embodiment, the hole 16 may be about 0.094 inches and the inside diameter of wall 20 about 0.154 inches.

The other prominent feature of cord release device 10 is the second opening 22 which is tear shaped and has a first rounded end 24 which extends from about the center of top 12 and gradually decreases in width as the opening approaches the junction of top 12 and skirt 14. At that point, the opening 22 continues to decrease in width to a second area designated 28 in the FIGURES which is located about midway along the height of skirt 14. A slot 25 exists between adjacent edges 29 and 30 of the skirt 14. From slot 25, the skirt 14 opens into a third area 32 of gradually increasing width to the skirts bottom edge, designated 34. It should be understood at this point that the opening 22 is continuous into area 32 and that the skirt material is severed along its entire height, thereby preventing the cord from being caught or hung up on any portion thereof.

Figure 3:
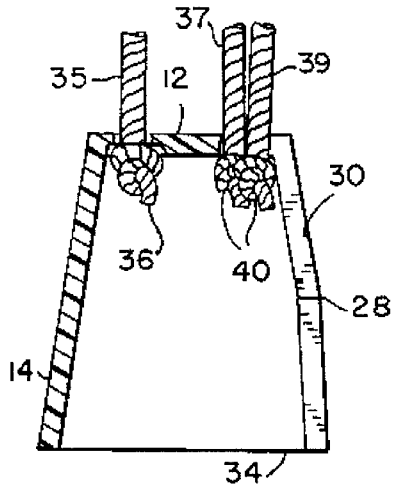
FIG. 3 is a cross section view of the device shown in FIGS. 1 and 2 showing three cords used therewith, one coupled to the device and two releasably received thereby, also illustrating compression of the device to illustrate how the cord ends are retained in the device when a user grasps and manipulates the device.
Figure 4:
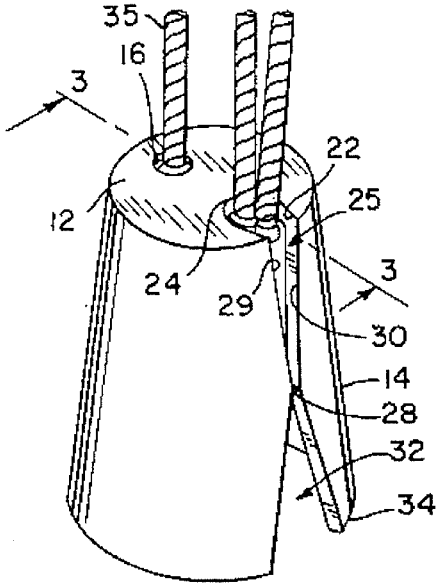
FIG. 4 is a view similar to FIG. 1 but showing the device compressed to prevent two of the cords from being released from the device.

Referring next to FIGS. 3 and 4, three cords are designated as 35, 37, and 39. Cord 35 is the aforementioned first cord and is shown in these FIGURES to penetrate hole 16. As explained previously, the end of this cord is knotted or otherwise enlarged so that device 10 is attached to cord 35. Cords 37 and 39, on the other hand, are not attached to device 10 but rather include knotted or otherwise enlarged ends 40 which are received within opening 22 so that they are located near the rounded area 24 thereof.

FIG. 4 also illustrates the compressibility of device 10 when it is grasped by the user. Because the body of device 10 is made from elastomeric material, grasping it around skirt 14 will cause a compression of the edges of the skirt 29 and 30, thereby restricting somewhat the size of slot 25. This prevents the ends 40 of cords 37 and 39 from being inadvertently released from device 10. As will be apparent to those skilled in the mini-blind art, such compression could take place during routine manipulations, e.g. the opening and closing of the blind.

Figure 5:
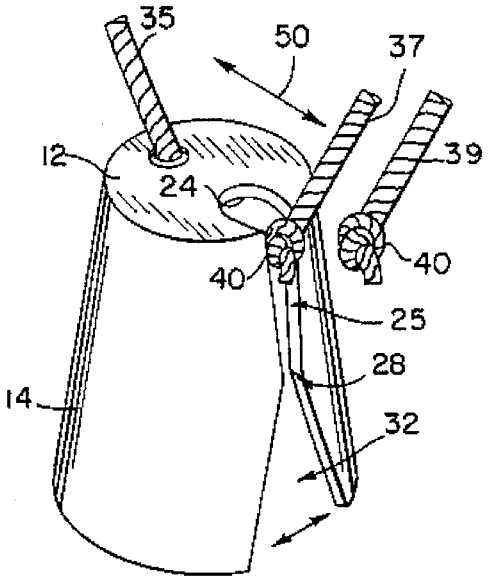
FIG. 5 is a view similar to FIGS. 3 and 4 and showing how a cord is released from the second opening when an object (not shown) is moved between two of the cords and toward the device.
Figure 6:
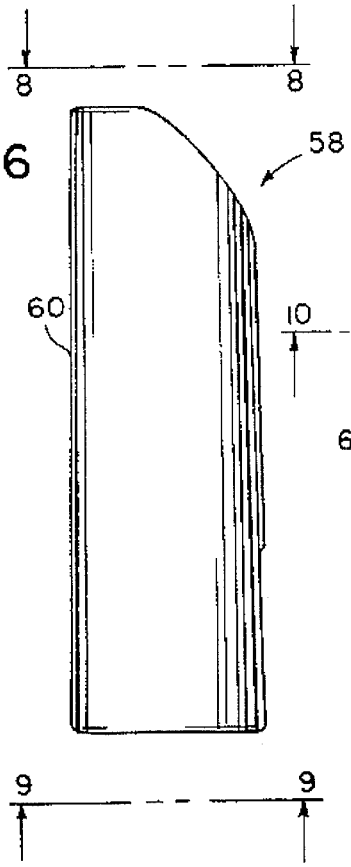
FIG. 6 is a side view of another form of one piece release device.
Figure 8:
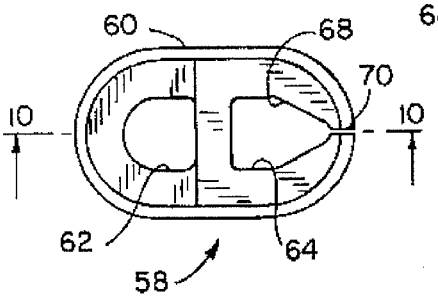
FIG. 8 is a top view taken on line 8—8 of FIG. 6.
Figure 7:
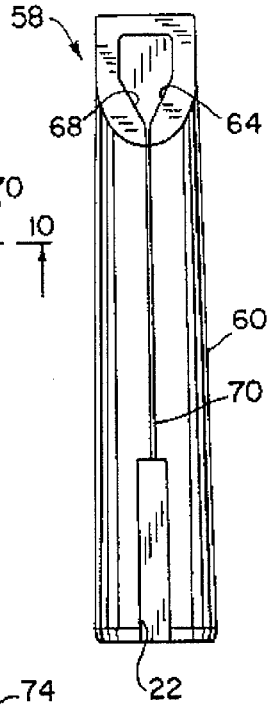
FIG. 7 is a front elevation view of FIG. 6.
Figure 9:
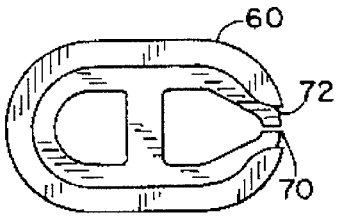
FIG. 9 is a view taken on line 9—9 of FIG. 6.
Figure 10:
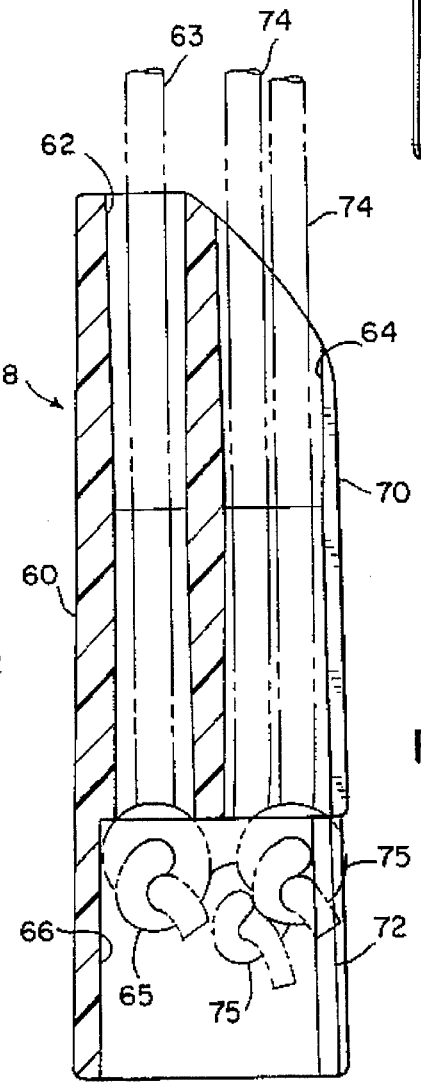
FIG. 10 is a view taken on line 10—10.

FIG. 5 is very similar to FIG. 4 except that the body of device 10 is in its relaxed state. In this configuration, the size of opening 25 is larger than that shown in FIG. 4, thereby providing greater freedom for the release of ends 40 of cords 37 and 39.

FIG. 5 is very similar to FIG. 4 except that the cords 35 and 39 are shown released from the device. The arrow 50 shows that a force is exerted in a downward direction toward device 10 and between cords 35, 37 and 39. FIG. 5 also illustrates that the knots 40 on the end of cords 37 and 39 are pushed outwardly through opening 22 so that they will release entirely from the device 10 and allow an object to fall freely without any resistance or constriction by the cords. A similar result would be achieved if an object was located between cords 35 and 37 or between cord 35 and both of cords 37 and 39. Similarly, if the object was in the area between cords 37 and 39 and not between cord 35, the forces would be sufficient to allow a quick and safe release of the knots 40.

Referring to FIGS. 6 through 10, an alternate one piece cord release device 58 is shown which has a generally elliptical shape and is also molded from the aforementioned polyvinyl chloride material. The cord release device 58 generally includes a housing 60 having a passage 62 in one side and a passage 64 on the other side. The passage 62 is large enough to allow a first cord 63 to be threaded through the passage 62. A knot 65 is tied at the free end of the cord 63 and thereby retained in a chamber 66 in the bottom of the housing 60. In this regard the knot 65 is out of the way when seated in the end of the passage 62 in the chamber 66.

The second passage 64 has a tear shaped opening 68 which is formed by tapering the upper end of one side of the housing. The hole 64 also terminates at the chamber 66. A slot 70 is provided on the outer edge of opening 64 which is contiguous to the chamber 66 and of sufficient flexibility to allow for the release of the cord housed therein. A slot 72 is provided on the side of the device 60 at the lower end of the slot 70 to accommodate the knot in the cord.

A pair of cords 74 are aligned in slot 64 and knotted at the end 75. The cords 74 will be forced outwardly from passage 64 when a lateral force is exerted against the cords 74 which opens the slot 70 to allow the cords to pass through slot 70 and the knot 75 to pass through slot 72. This embodiment is also compressible and when grasped by the user the slot 70 is closed, thereby restricting the cord from passing through the slot 70.

Referring to FIGS. 11 through 16, another embodiment of the invention is shown in the form of a hand held break away head 80 which includes a semicircular body 82 having a passage 84 on one side and a passage 86 on the other side. The outer wall of passage 86 includes a slot 88 between adjacent edges 87 and 89 which forms a constriction from the top to the bottom of passage 86. A cord 92 is aligned in each of the passages 84 and 86 and a tassel 90 is suspended on the end of each cord 92 by means of a knot 94. The tassels 90 abut the bottom of the body 82. The outer wall of the passage 86 is sufficiently flexible to allow the cord 92 to open the slot 88 when a lateral force is applied to the outer wall of passage 86.

While the present invention has been described in connection with a particular preferred embodiment, variations can be made as indicated previously in this section of the specification. For example, the precise configuration of opening 22 is not critical, as long as it is constructed in a manner that will allow ready release of the knots 40 when an object, such as object 50, is forced between the cords and toward device 10. Accordingly, the scope of the invention is to be determined based on the scope of the claims which follow.

The embodiments of the invention in which an exclusive property or privilege is claimed are defined as follows:

1. A cord release device for holding two or more cords and for releasing at least one of the cords, comprising:

a hollow skirt-shaped body having an interior cavity, an elongated outer surface an open bottom and a top, the body being configured to receive and at least partially conceal ends of the cords within said cavity;

a first opening in the top for receiving a first of the cords; and a second opening extending through the top and along the outer surface of the body for receiving a second cord and for permitting the release of the second cord, said first and second openings providing access to said cavity.

2. The cord release device of claim 1, wherein the first opening is a hole.

3. The cord release device of claim 1, wherein the top includes an upper surface and a lower surface and wherein a wall is provided on the lower surface about the hole.

4. The cord release device of claim 1, wherein the outer surface is in the shape of a truncated cone.

5. The cord release device of claim 1, wherein the cord release device is constructed from an elastomeric material.

6. The cord release device of claim 5, wherein the outer surface is shaped like a truncated cone and wherein the second opening is constricted if the cross-section of the elastomeric body is reduced.

7. In combination, at least two cords having generally adjacent cord ends and a cord release device, the cord release device comprising:

a body having an outer surface, the outer surface forming a hollow, skirt-shaped body for receiving and at least partially concealing a portion of the cords adjacent to the ends thereof; and a first opening in the top and a second opening extending through the top and along the outer surface of the body, a first one of the cords extending through the first opening and being enlarged at its end to slidingly attach the first cord to the cord release device, the remaining cord having an enlarged end and being releasably received within the body through the second opening.

8. The invention of claim 7, wherein the first opening is a hole.

9. The invention of claim 8, wherein the top includes an upper surface and a lower surface and wherein a wall is provided on the lower surface about the hole.

10. The invention of claim 7, wherein the outer surface is in the shape of a truncated cone.

11. The invention of claim 7, wherein the second opening includes a first portion in the top and including an interior first end and a second end at the periphery of the top, the second opening further including an additional portion extending along the length of the outer surface.

12. The invention of claim 10, wherein the cord release device is constructed from an elastomeric material.

13. The invention of claim 11, wherein the second opening is constructed so that when radially and inwardly directed forces are exerted on the outer surface, the remaining cords are retained within the body and wherein the cord release device returns to its original shape when any such radial forces are removed.

14. A method for engaging a plurality of cords and for releasing one or more of said cords from a cord release device when an object exerts a force thereon, the cords having generally adjacent free ends, the method comprising the steps of:

providing a cord release device comprising a generally hollow skirt-shaped body having an open bottom, an outer surface and a top, a first opening being formed in the top and a second opening extending through the top and along the outer surface of the body, the body being configured to lodge and at least partially conceal a portion of the cords adjacent to the ends thereof;

attaching the free end of a first cord to the cord release device through the first opening thereof; and placing the free end of at least one additional cord through the second opening and into the body, the second opening being constructed to allow the free end of the at least one additional cord to be released from the cord release device when an object exerts forces between the first and additional cords and toward the device.

15. The method of claim 14, wherein the first opening is a hole and wherein the free end of the first cord is attached by inserting it through the hole and thereafter enlarging the free end to a size exceeding that of the hole.

16. The method of claim 14, wherein the cord release device is made of an elastomeric material.

17. In combination, at least two window blind cords having enlarged ends and a cord release device, the cord release device comprising a body having it hollow, skirt-shaped outer surface within which the enlarged ends of the cords are lodged, first and second openings in the body, and a slot extending along the outer surface of the second opening, one of the cords extending through the first opening and having an enlarged end to attach the first cord to the cord release device, the second cord extending through the second opening and having an enlarged end to slidingly attach the second cord to the cord release device whereby a lateral force applied to the second cord will pull the second cord through the slot.

* * * * *